US005085964A

United States Patent [19]

Kawata et al.

[11] Patent Number: 5,085,964

[45] Date of Patent: Feb. 4, 1992

[54] CARRIER FOR DEVELOPER

[75] Inventors: Hideaki Kawata; Masatomi Funato; Kiminori Umeda; Nobuaki Kawano; Koji Honda, all of Osaka, Japan

[73] Assignee: Mita Industrial Co., Ltd., Osaka, Japan

[21] Appl. No.: 550,990

[22] Filed: Jul. 11, 1990

[30] Foreign Application Priority Data

Jul. 14, 1989 [JP] Japan ..... 1-183150

[51] Int. Cl.[5] ..... G03G 9/10

[52] U.S. Cl. ..... 430/106.6; 430/108; 430/904

[58] Field of Search ..... 430/106.6, 108, 904

[56] References Cited

U.S. PATENT DOCUMENTS 4,977,054 12/1990 Honjo et al. ..... 430/106.6

*Primary Examiner*—Marion E. McCamish
*Assistant Examiner*—S. Rosasco
*Attorney, Agent, or Firm*—Sherman and Shalloway

[57] ABSTRACT

A specific silicone oil having a vicinal epoxy group is coated on a carrier for a developing or incorporated in a coating resin layer of a carrier for a developer. In this carrier, the spending phenomenon is prevented, the moisture resistance and flowability are improved, and a stable friction chargeability can be maintained for a long time and the durability is highly improved.

7 Claims, No Drawings

CARRIER FOR DEVELOPER

BACKGROUND OF THE INVENTION (1) Field of the Invention

The present invention relates to a carrier for a developer, which is used in the electrophotographic process of the like. More particularly, the present invention relates to a carrier for a developer, which has highly improved flowability and durability.

(2) Description of the Related Art

In the electrophotographic process using a two-component type developer, a toner composed of colored resin particles comprising a colorant dispersed in a binder resin is mixed with a carrier composed of iron powder or ferrite, this two-component type developer is supplied onto a developing sleeve, in which magnets are disposed, to form a magnetic brush of this developer composition, and this magnetic brush is brought into frictional contact with a photosensitive layer of a photoconductive substance having an electrostatic latent image to form a toner image on the photosensitive layer. The toner gets a desired frictional charge by the friction with the magnetic carrier, and the toner on the magnetic brush is transported to the electrostatic latent image on the photosensitive layer by an electrostatic force or the like to adhere to the photosensitive layer and effect the development of the electrostatic latent image. The toner image formed by the development on the photosensitive layer is transferred onto a transfer material such as a transfer sheet and is fixed onto the transfer material by heat or pressure to form an image.

Since the toner in the developing device is consumed for the formation of images, in order to perform the formation of images repeatedly, it is necessary that a fresh toner should be supplied in an amount corresponding to the consumption into the developing device and should be promptly charged by stirring and friction with the magnetic carrier. However, while the developing operation is repeated, a toner film is formed on the surface because of deterioration called "spending phenomenon". Moreover, since the magnetic carrier is hygroscopic, good control of the charge becomes impossible. Accordingly, for overcoming this advantage, there has been adopted a method in which the magnetic carrier is coated with a resin or silicone oil to prevent the spending phenomenon and impart a moisture resistance to the carrier. In a carrier having this coating layer, the above-mentioned disadvantage can be overcome to some extent, and furthermore, another merit is attained in that the electric resistance can be freely adjusted. Therefore, carriers of this type are now used in large quantities, and many carriers having a resin coating layer in which a silicone oil is incorporated have recently been proposed.

Recently, in an image-forming apparatus such as a copying machine, the speed is increased and images are formed at a speed of 50 to 70 sheets (A-4 size) per minute. Moreover, the frequency of use of the copying machine is recently increased and hence, stirring of the developer is carried out at a high speed frequently. Accordingly, the improvement of the durability of the developer, especially the carrier, is an important technical problem.

The carrier having silicone oil incorporated in the above-mentioned coating layer is improved to some extent over the uncoated carrier in the moisture resistance and the prevention of the spending phenomenon.

However, under severe copying operation conditions where stirring is carried out at a high speed or continuously for a long time, the surface state of the coating layer is degraded presumably because the fixation between the silicone oil and the carrier core material or between the silicone oil and the coating resin is insufficient, and the flowability of the developer is degraded by the stickiness of the silicone oil and rising of the charging is insufficient, with the result that charge quantity is often changed and fogging is caused or the image density is reduced. This disadvantage becomes conspicuous as the copying operation is continued.

SUMMARY OF THE INVENTION

Under this background, the present invention has been completed. It is therefore a primary object of the present invention to provide a carrier for a developer, in which the fixation of a silicone oil to the carrier core is sufficiently effected to prevent the spending phenomenon and improve the moisture resistance and in which a good flowability and a stable frictional chargeability can be maintained for a long time and the durability is highly improved.

More specifically, in accordance with one fundamental aspect of the present invention, there is provided a carrier for a developer, which has a coating layer formed on a carrier core material, said coating layer comprising a silicone oil represented by the following general formula:

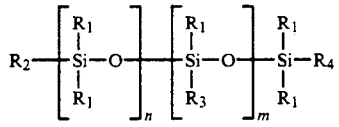

wherein $R_1$ represents an alkyl group having 1 to 4 carbon atoms or a phenyl group, $R_2$, $R_3$ and $R_4$ represent an alkyl group having 1 to 4 carbon atoms, a phenyl group or a monovalent organic group having at least one vicinal epoxy group, with the proviso that at least one of $R_2$, $R_3$ and $R_4$ is a monovalent organic group having at least one vicinal epoxy group, and n and m are positive integers.

In accordance with another aspect of the present invention, there is provided a carrier for a developer, which has a coating resin layer formed on a carrier core material, said coating resin layer containing at least a silicone oil represented by the following general formula:

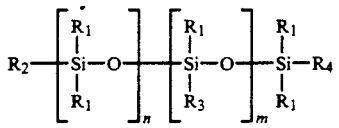

wherein $R_1$ represents an alkyl group having 1 to 4 carbon atoms or a phenyl group, $R_2$, $R_3$ and $R_4$ represent an alkyl group having 1 to 4 carbon atoms, a phenyl group or a monovalent organic group having at least one vicinal epoxy group, with the proviso that at least one of $R_2$, $R_3$ and $R_4$ is a monovalent organic group having at least one vicinal epoxy group, and n and m are positive integers.

DETAILED DESCRIPTION OF THE INVENTION

The present invention is characterized in that an epoxy-modified silicone oil represented by the general formula (1) is used as the silicone oil incorporated into the coating layer.

If this silicone oil is incorporated, the glycidyl group introduced into the silicone oil reacts with the hydroxyl group on the surface of the carrier core or in the coating resin to cause effective fixation of the silicone oil to the surface of the carrier, whereby the spending phenomenon is prevented, the environment resistance is improved and furthermore, good flowability and charging stability can be maintained for a long time and the durability is highly improved.

In view of the adjustment of the electric resistance and the durability, in the carrier for a developer according to the present invention, the silicone oil represented by the general formula (1) is preferably incorporated into a coating resin layer, but an excellent effect is attained even if the carrier core material is coated with the silicone oil alone.

The silicone oil used in the present invention is represented by the above-mentioned general formula (1) and has a structure in which a glycidyl group is introduced into a polysiloxene.

In the general formula (1), as pointed out hereinbefore, $R_1$ represents an alkyl group having 1 to 4 carbon atoms or a phenyl group, and $R_2$, $R_3$ and $R_4$ represent an alkyl group having 1 to 4 carbon atoms, a phenyl group or a monovalent organic group having at least one vicinal epoxy group, with the proviso that at least one of $R_2$, $R_3$ and $R_4$ is a monovalent organic group having at least one vicinal epoxy group.

As the monovalent organic group having at least one vicinal epoxy group, the following groups can be mentioned, though groups that can be used are not limited to them:

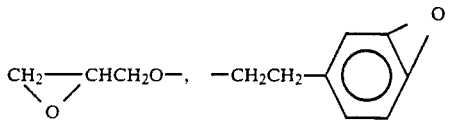

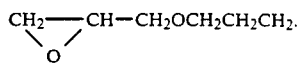

As the structure of the silicone oil, the following structures can be mentioned, though structures that can be used are not limited to them:

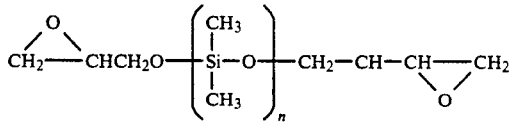

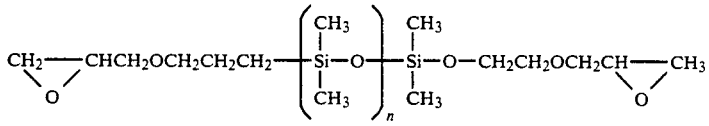

and

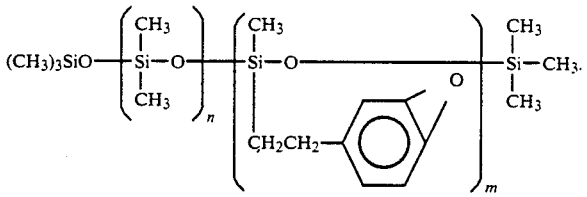

It is preferred that m and n in the general formula (1) be integers of from 2 to 8, especially intergers of from 3 to 7.

As the silicone oil satisfying the foregoing requirements, for example, KF-100T, KF-101, KF-102, KF-103, KF-105, X-60-164 and X-22-3667 (tradenames for products supplied Shinetsu Silicone), and TSF-4730, XF42-301 and TF-3965 (tradenames for products supplied by Toshiba Silicone) are commercially available.

The silicone oil is used in an amount of 0.00001 to 10% by weight, preferably 0.0001 to 5% by weight, based on a carrier core material described below. If the silicone oil is used in too large an amount exceeding the above-mentioned range, the surface of the coating layer becomes uneven and the durability and flowability are adversely influenced. If the amount of the silicon oil is too small and below the above-mentioned range, the intended effect of the present invention by the silicone oil is not exerted, and the improvement of the environment resistance, the prevention of the spending phenomenon and the improvement of the durability cannot be expected.

If the silicone oil is used in combination with a coating resin, it is preferred that the silicone oil be used in an amount of at least 0.01% by weight, especially at least 0.1% by weight, based on the coating resin.

Any of known carrier core materials for developers in the electrophotographic process can be used as the carrier core material in the present invention. For example, there can be mentioned iron oxide, reduced iron, copper, ferrite, nickel and cobalt, and their alloys with zinc, aluminum and the like. However, ferrite type particles in which changes of the electric resistance by the environment or with the lapse of time are small and which can form soft brushed are preferably used. For example, there can be mentioned Zn type ferrite, Ni type ferrite, Cu type ferrite, Mn type ferrite, Ni-Zn type ferrite, Mn-Mg type ferrite, Cu-Mg type ferrite, Mn-Zn type ferrite and Mn-CU-Zn type ferrite. Mn-Cu-Zn type ferrite is especially preferable. The core material has a particle size of 10 to 200 μm, preferably 30 to 150 μm. It is preferred that the saturation magnetization of the core material be 35 to 70 emu/g, especially 40 to 65 emu/g.

Any of known coating resins for carriers can be used in combination with the silicone oil in the present invention. For example, at least one member selected from acrylic resins, styrene resins, polyester resins, epoxy resins, silicone resins, urethane resins, polyacetal resins, polyamide resins, polycarbonate resins, phenolic resins, vinyl acetate resins, cellulose resins, polyolefin resins, fluorine resins and amino resins can be used.

For the production of the carrier of the present invention, the carrier core material can be coated with the silicone alone, or the silicone oil diluted with a solvent can be coated on the carrier core material. As the solvent, there can be used aromatic hydrocarbons such as toluene and xylene, halogenated hydrocarbons such as trichloroethylene and perchloroethylene, ketones such as acetone and methylethylketone, cyclic ethers such as tetrahydrofuran, and alcohols such as methanol, ethanol and isopropyl alcohol, Preferably, the concentration of the silicone oil is 0.1 to 80% by weight. When the silicone oil is used in combination with the coating resin, preferably the coating resin and the silicone oil are dissolved in an appropriate solvent as mentioned above. In this case, the resin concentration in the resin solution is 0.05 to 50% by weight, preferably about 0.1 to 40% by weight.

A known mixing machine such as a Henschel mixer (supplied by Mitsui Miike Seisakusho), a V-type blender (supplied by Fuji Powder) or a Nauta mixer (supplied by Hosokawa Micron) can be used as the treating machine for the coating operation. Alternatively, there can be adopted a method in which the above-mentioned solution is coated on the surface of the carrier core material, the solvent is evaporated by heating and drying, and if desired, a heat treatment is further carrier out to effect curing.

At the heating and drying step, the heating temperature is preferably 30° to 150° C., though the heating temperature depends on the kind and amount of the solvent. The curing reaction after the heating and drying step is carried out at a temperature of 80° to 600° C., especially 100° to 400° C. Other additive can be incorporated into the coating layer. For example, there can be used silica, alumina, carbon black and a metal salt of a fatty acid.

It is preferred that the electric resistance of the carrier of the present invention be adjusted to $10^4$ to $10^{14}$ Ω-cm, especially $10^6$ to $10^{14}$ Ω-cm. This electric resistance can be adjusted by changing the electric resistance of the carrier core material used, the thickness of the coating layer and the kind and amount of the additive.

The carrier of the present invention is mixed with a toner composed of resin particles having a particle size of 5 to 25 μm and consisting of a dispersion of known additives such as a colorant in a known insulating binder resin to form a developer. In the present invention, the carrier/toner mixing weight ratio is preferably adjusted to from 98/2 to 90/10. External additives such as silica, alumina, tin oxide, strontium oxide and various resin powders can be simultaneously incorporated at this step of forming the developer.

The present invention will now be described in detail with reference to the following examples that by no means limit the scope of the invention.

EXAMPLE 1

Carrier

In a fluidized bed coating apparatus, the coating treatment was carried out by using 10 parts by weight of a silicone oil (KF-101 supplied by Shinetsu Silicone) diluted with 200 parts by weight of toluene and 10000 parts by weight of ferrite carrier particles having an average particle size of 100 μm as the carrier core material. Then, the obtained product was dried at a temperature of 50° C. to remove the solvent, and the heat treatment was further carried out at 200° C. to advance the curing reaction. The electric resistance of the obtained carrier was $1.1\times10^{10}$Ω-cm.

Toner

A composition comprising 100 parts by weight of a styrene/acrylic copolymer, 10 parts by weight of carbon black (MA-100 supplied by Mitsubishi Kasei), 1.5 parts by weight of a charge controlling agent (Bontron S-32 supplied by Orient Kagaku) and 3 parts by weight of low-molecular-weight polypropylene (Viscol supplied by Sanyo Kasei) was preliminarily mixed by a Henschel mixer, melt-kneaded by a twin-screw extruder and naturally cooled. The kneaded product was roughly pulverized by a cutting mill and finely pulverized by an ultrasonic jet mill, and particles having a size smaller than 5 μm were removed by an Alpine classifying machine to obtain a toner having a particle size ranging from 5 to 20 μm and an average particle size of 11 μm.

The above-mentioned carrier and toner were mixed together to obtain a developer having a toner concentration of 3.5%, and by using this developer, the printing test for obtaining 100000 prints was carried out in a remodelled machine of Electrophotographic Copying Machine DC-5585 (supplied by Mita Industrial Co., Ltd.; copying speed = 55 A-4 sheets per minutes). It was found that at the initial copy, the image density (ID) was 1.35, the fog density (FD) was 0.001 and the spent amount was 0% and at the 100000th copy, ID was 1.32, FD was 0.02 and the spent amount was 0.05%. Accordingly, it was confirmed that good images could be obtained for a long period. When the above printing test was repeated under high-temperature and high-humidity conditions (the temperature was 35° C. and the relative humidity was 85%), 100000 images having good image characteristics similar to those mentioned above were obtained.

EXAMPLE 2

In a fluidized bed coating apparatus, the coating treatment was carried out by using 9.9 parts by weight of a silicone resin as the coating resin, 0.1 part by weight of a silicone oil (KF-101 supplied by Shinetsu Silicone) diluted with 200 parts by weight of toluene and 1000 parts by weight of ferrite carrier particles having an average particle size of 100 μm as the carrier core material. The product was dried at 50° C. to remove the solvent and the heat treatment was then carried out at 200° C. to advance the curing reaction. The obtained carrier had an electric resistance of $1.4\times10^{10}\Omega$-cm.

A developer having a toner concentration of 3.5% was prepared by using this carrier and the same toner as used in Example 1, and the printing test for obtaining 100000 prints was carried out in the same manner as described in Example 1. It was found that at the initial copy, the image density (ID) was 1.40, the fog density (FD) was 0.003 and the spent amount was 0% and at the 100000th copy, ID was 1.42, FD was 0.001 and the spent amount 0.06%. Accordingly, it was confirmed that good images were obtained for a long time. Even under high-temperature and high-humidity conditions (the temperature was 35° C. and the relative humidity was 85%), good images having image characteristics substantially equal to those mentioned above were obtained through 100000 copies.

COMPARATIVE EXAMPLE 1

In a fluidized bed coating apparatus, the coating treatment was carried out by using 10 parts by weight of a silicone resin as the coating resin, diluted with 200 parts by weight of toluene, and 1000 parts by weight of ferrite carrier particles having an average particle size of 100 μm as the carrier core material. Then, the product was dried at 50° C. to remove the solvent, and the heat treatment was further carried out to advance the curing reaction. The electric resistance of the obtained carrier was $1.5\times10^{10}\Omega$-cm.

A developer having a toner concentration of 3.5% was prepared by using the obtained carrier and the same toner as used in Example 1, and by using this developer, the printing test for obtaining 100000 prints was carried out in the same manner as described in Example 1. It was found that at the initial copy, the image density (ID) was 1.43, the fog density (FD) was 0.001 and the spent amount was 0% and at the 100000th copy, ID was 1.50, FD was 0.008 and the spent amount was 0.50%. As the copying operation was continued, fogging became conspicuous and the spent amount increased.

Under high-temperature and high-humidity conditions (the temperature was 35° C. and the relative humidity was 85%), fogging became more conspicuous and after the 50000th copy, abnormal increase of the image density was observed.

COMPARATIVE EXAMPLE 2

A coated carrier was prepared in the same manner as described in Example 1 except that 10 parts by weight of a dimethyl silicone oil (KF-96 supplied by Shinetsu Silicone) was used as the silicone oil. The electric resistance of the obtained carrier was $3901.1\times10^{10}\Omega$-cm.

A developer having a toner concentration of 3.5% was prepared by using the above carrier and the same toner as used in Example 1. Since the surface of the carrier was uneven, the flowability was very low and the product could not be practically used as a developer.

COMPARATIVE EXAMPLE 3

A coated carrier was prepared in the same manner as described in Example 2 except that a dimethyl silicone oil (KF-96 supplied by Shinetsu Silicone) was used as the silicone oil. The electric resistance of the carrier was $1.5\times10^{10}\ \Omega$-cm.

The printing test was carried out in the same manner as described in Example 1. It was found that at the initial copy, the image density (ID) was 1.43, the fog density (FD) was 0 and the spent amount was 0% and at the 100000th copy, ID was 1.50, FD was 0.006 and the spent amount was 0.46%. As the copying operation was continued, fogging became conspicuous and the spent amount increased.

Under high-temperature and high-humidity conditions (the temperature was 35° C. and the relative humidity was 85%), fogging became more conspicuous and after the 50000th copy, abnormal increase of the image density was observed.

As is apparent from the results obtained in the examples, according to the present invention, the fixation of the silicone oil to the carrier core material or the coating resin is enhanced and the surface of the carrier becomes uniform and smooth. Therefore, the spending phenomenon can be prevented and the environment resistance and flowability can be highly improved, and moreover, the number of obtainable copies having good image characteristics can be drastically increased.

What is claimed is:

1. A carrier for a developer, which has a coating layer formed on a carrier core material, said coating layer comprising a silicone oil represented by the following general formula:

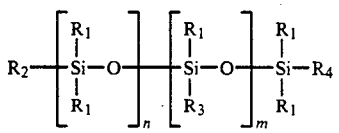

where $R_1$ represents an alkyl group having 1 to 4 carbon atoms or a phenyl group, $R_2$, $R_3$ and $R_4$ represent an alkyl group having 1 to 4 carbon atoms, a phenyl group or a monovalent organic group having at least one vicinal epoxy group, with the proviso that at least one of $R_2$, $R_3$ and $R_4$ is a monovalent organic group having at least one vicinal epoxy group, and n and m are positive integers.

2. A carrier as set forth in claim 1, wherein the carrier core material is coated with up to 10% by weight of the silicone oil.

3. A developer as set forth in claim 1, wherein the carrier core material is a ferrite type core material.

4. A carrier for a developer, which has a coating resin layer formed on a carrier core material, said coating resin layer containing at least a silicone oil represented by the following general formula:

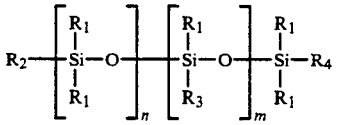

wherein $R_1$ represents an alkyl group having 1 to 4 carbon atoms or a phenyl group, $R_2$, $R_2$, $R_3$ and $R_4$ represent an alkyl group having 1 to 4 carbon atoms, a phenyl group or a monovalent organic group having at least one vicinal epoxy group, with the proviso that at least one of $R_2$, $R_3$ and $R_4$ is a monovalent organic group having at least one vicinal epoxy group, and n and m are positive integers.

5. A carrier as set forth in claim 4, wherein the silicone oil is contained in an amount of at least 0.01% by weight based on the coating resin.

6. A carrier as set forth in claim 4, wherein the silicone oil is contained in the coating resin in an amount of up to 10% by weight based on the carrier core material.

7. A carrier as set forth in claim 4, wherein the carrier core material is a ferrite type core material.

* * * * *